US007988270B2

(12) United States Patent
Umeda

(10) Patent No.: US 7,988,270 B2
(45) Date of Patent: Aug. 2, 2011

(54) INKJET PRINTER

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 952 days.

(21) Appl. No.: 11/903,934

(22) Filed: Sep. 25, 2007

(65) Prior Publication Data

US 2008/0079787 A1 Apr. 3, 2008

(30) Foreign Application Priority Data

Sep. 29, 2006 (JP) ..... 2006-267575

(51) Int. Cl.
*B41J 2/175* (2006.01)

(52) U.S. Cl. ..... 347/85

(58) Field of Classification Search ..... 347/85, 347/86, 87

See application file for complete search history.

(56) References Cited

U.S. PATENT DOCUMENTS 5,148,194 A * 9/1992 Asai et al. ..... 347/49
5,276,467 A * 1/1994 Meyer et al. ..... 347/19
6,227,661 B1 * 5/2001 Hayakawa ..... 347/86
6,302,530 B1 * 10/2001 Shimada et al. ..... 347/86
6,634,739 B2 * 10/2003 Hayashi et al. ..... 347/86
6,663,233 B2 * 12/2003 Otsuka et al. ..... 347/85
7,290,869 B2 * 11/2007 Hanaoka ..... 347/86
7,533,975 B2 * 5/2009 Koga et al. ..... 347/85
2005/0057624 A1 3/2005 Hanaoka
2006/0192821 A1 8/2006 Koga et al.

FOREIGN PATENT DOCUMENTS

JP 2006240039 9/2006

* cited by examiner

*Primary Examiner* — Anh T. N. Vo
(74) *Attorney, Agent, or Firm* — Frommer Lawrence & Haug LLP

(57) ABSTRACT

An inkjet printer including a printhead unit. The printhead unit includes a printhead for ejecting ink onto a sheet and a plurality of sub-tanks for supplying the ink to the printhead. The printhead unit is configured to reciprocate in a main scanning direction that is perpendicular to a sheet conveying direction. The plurality of sub-tanks is arranged such that two of the plurality of sub-tanks are adjacent to each other. The adjacent two sub-tanks overlap with each other, at least partially, both as seen in a direction parallel to the main scanning direction and as seen in a direction parallel to the sheet conveying direction.

12 Claims, 9 Drawing Sheets

UP
DOWN
SHEET CONVEYING DIRECTION
100
110
120
121
122
122A
122B
122D
130
131
132
140
150
151
153
153A
154
155
160
161
162
163
164
165
166
170
180
181
182
183

INKJET PRINTER

This application claims priority from Japanese Patent Application No. 2006-267575 filed on Sep. 29, 2006, the entire subject matter of which is incorporated herein by reference.

BACKGROUND OF THE INVENTION

1. Field of the Invention

The invention relates to an inkjet printer including a sub-tank mounted on a printhead unit (carriage) and a main tank disposed in a main body of the inkjet printer and filled with ink to be supplied to the sub-tank. Particularly, the invention may be effectively applied to an inkjet printer adopting a station type ink supply system in which main and sub-tanks are connected to each other when ink is supplied from the main tank to the sub-tank, and the main and sub-tanks are otherwise disconnected from each other.

2. Description of Related Art

As disclosed in Japanese Laid-Open Patent Publication No. 2006-240039, sub-tanks mounted on a printhead unit are usually arranged side by side in a main scanning direction of the printhead unit such that adjacent two sub-tanks do not overlap, as seen from the front of an inkjet printer.

In order to reduce the size of a printhead unit in its main scanning direction, it is necessary to reduce a dimension of a mounting space for sub-tanks in a direction parallel to the main scanning direction. Hereinafter, this dimension is referred to as a mounting width of sub-tanks. When the sub-tank is made small in size, the amount of ink stored in the sub-tank might be reduced, necessitating frequent ink supplies from the main tank to the sub-tank and decreasing the benefit of having a sub-tank that is disconnectable from the main tank.

In view of the forgoing problem, it is an object of the invention to provide a printhead unit in which the mounting width of sub-tanks is made small without reducing the size of each sub-tank.

SUMMARY OF THE INVENTION

An inkjet printer including a printhead unit. The printhead unit includes a printhead for ejecting ink onto a sheet and a plurality of sub-tanks for supplying the ink to the printhead. The printhead unit is configured to reciprocate in a main scanning direction that is perpendicular to a sheet conveying direction. The plurality of sub-tanks is arranged such that two of the plurality of sub-tanks are adjacent to each other. The adjacent two sub-tanks overlap with each other, at least partially, both as seen in a direction parallel to the main scanning direction and as seen in a direction parallel to the sheet conveying direction.

An inkjet printer including (1) a printhead unit including a printhead for ejecting ink onto a sheet and a plurality of sub-tanks for supplying ink to the printhead, the printhead unit being configured to reciprocate in a main scanning direction that is perpendicular to a sheet conveying direction, (2) a plurality of main tanks, each of which stores ink, (3) a plurality of ink supply units, each configured to connect one of the main tanks to a corresponding one of the sub-tanks, and (4) a plurality of pushing units, each configured to push a corresponding one of the sub-tanks in a direction perpendicular to both the main scanning direction and the sheet conveying direction. Wherein the plurality of sub-tanks is arranged such that two of the plurality of sub-tanks are adjacent to each other. Wherein one of the supply units connects the one of the main tanks to its corresponding one of the sub-tanks when one of the pushing units pushes the one of the sub-tanks. Wherein one of the main tanks supplies ink to its corresponding one of the sub-tanks when one of the supply units connects the one of the main tanks to its corresponding one of the plurality of sub-tanks. Wherein each of the sub-tanks has a form of bellows that are expandable and contractible in the direction perpendicular to both the main scanning direction and the sheet conveying direction. Wherein $A<nW$, where A is a mounting dimension of the plurality of sub-tanks on the printhead unit in a direction parallel to the main scanning direction, W is the maximum dimension of each of the sub-tanks in the direction parallel to the main scanning direction, and n is the number of the plurality of sub-tanks.

DETAILED DESCRIPTION OF EMBODIMENTS

Figure 1:
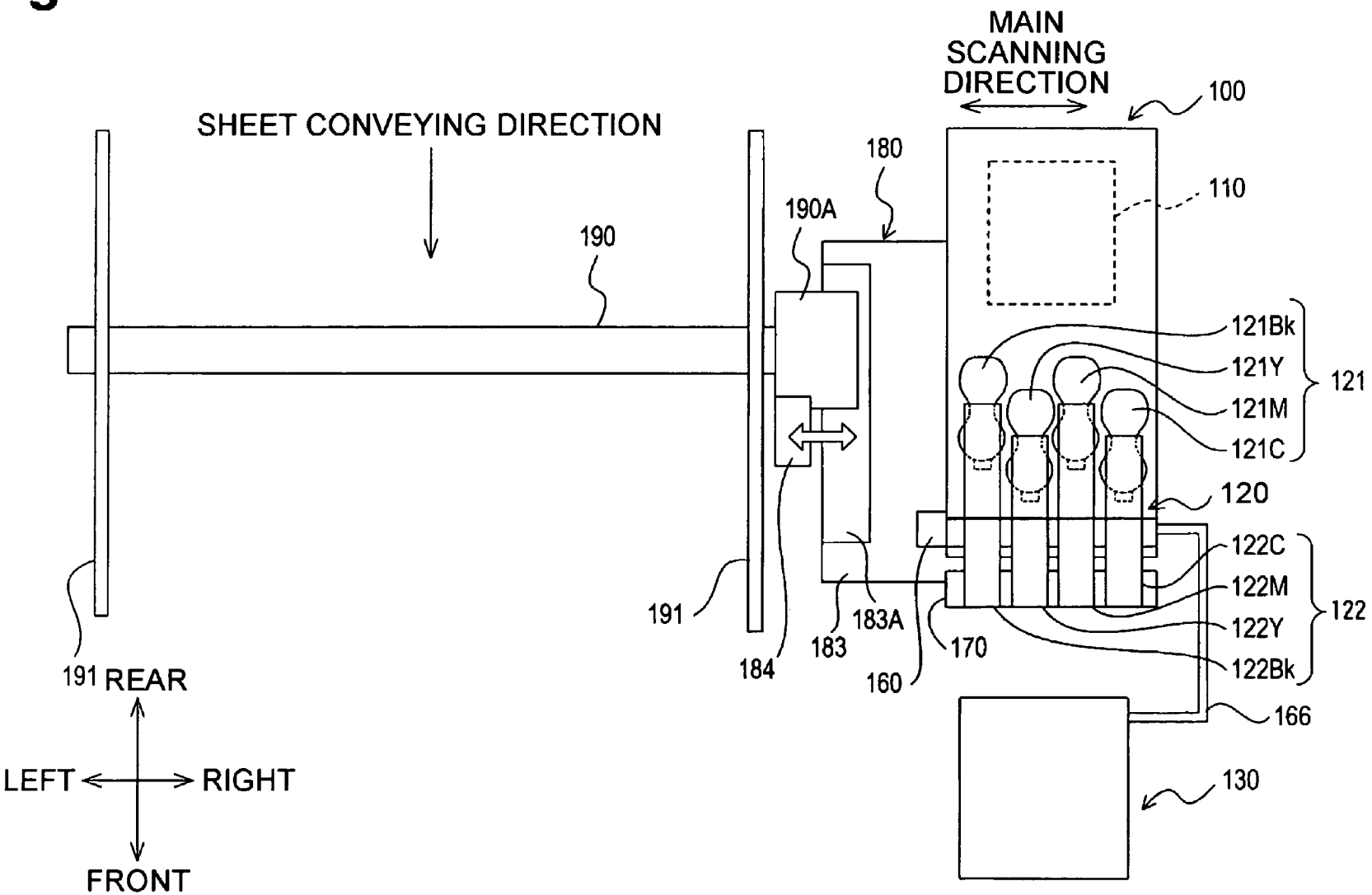
FIG. 1 is a schematic view of an inkjet printer as viewed from the above, according to a first embodiment of the invention.

Referring now to the drawings, the present invention will be described in detail on the basis of the preferred embodiments.

An inkjet printer forms an image on a sheet of recording media by ejecting ink droplets onto the sheet. The inkjet printer forms a multi-color image by overlapping inks of basic colors including cyan, magenta, yellow, and black.

In a station type ink supply system, a main tank unit 130 and a sub-tank 121 are connected to each other to enable ink to be supplied from the main tank unit 130 to the sub-tank 121. The main tank unit 130 and the sub-tank 121 are disconnected from each other when the main tank unit 130 is not supplying the sub-tank unit 121 with ink. In this way, the station type ink supply system enables an ink supply path between a sub-tank 121 and a main tank 130 to be connectable/disconnectable.

In the first embodiment, when the amount of ink remaining in the sub-tank 121 becomes less than a predetermined amount, ink is supplied from the main tank unit 130 to the sub-tank 121 while they are connected to each other. When the amount of ink remaining in the sub-tank 121 is greater than the predetermined amount, the main tank unit 130 and the sub-tank 121 are kept disconnected from each other.

A printhead unit (carriage) 100 includes a printhead 110 that ejects ink droplets onto the sheet, and a sub-tank unit 120 that supplies ink to the printhead 110. When forming an image, the printhead unit 100 reciprocates in a main scanning direction (right-left direction in FIG. 1) that is perpendicular to a sheet conveying direction.

Nozzles for ejecting basic color inks are formed in a surface of the printhead 110 that faces the sheet to be conveyed. The nozzles are arranged in arrays parallel to the sheet conveying direction. Each nozzle array corresponds to a particular one of the basic color inks.

The sub-tank unit 120 includes sub-tanks 121C, 121M, 121Y, 121Bk, arranged side by side in the main scanning direction, and levers 122C, 122M, 122Y, 122 Bk, each pushing a corresponding one of the sub-tanks 121C, 121M, 121Y, 121Bk.

The sub-tank 121C is filled with a cyan ink, the sub-tank 121M is filled with a magenta ink, the sub-tank 121Y is filled with a yellow ink, and the sub-tank 121Bk is filled with a black ink.

The sub-tanks 121C, 121M, 121Y, and 121Bk are collectively called sub-tank(s) 121, because they are the same except for the color of the ink to be stored therein. Also, the levers 122C, 122M, 122Y, 122Bk are collectively called lever(s) 122 because they are the same except that they push different sub-tanks 121.

Figures 3A, 3B:
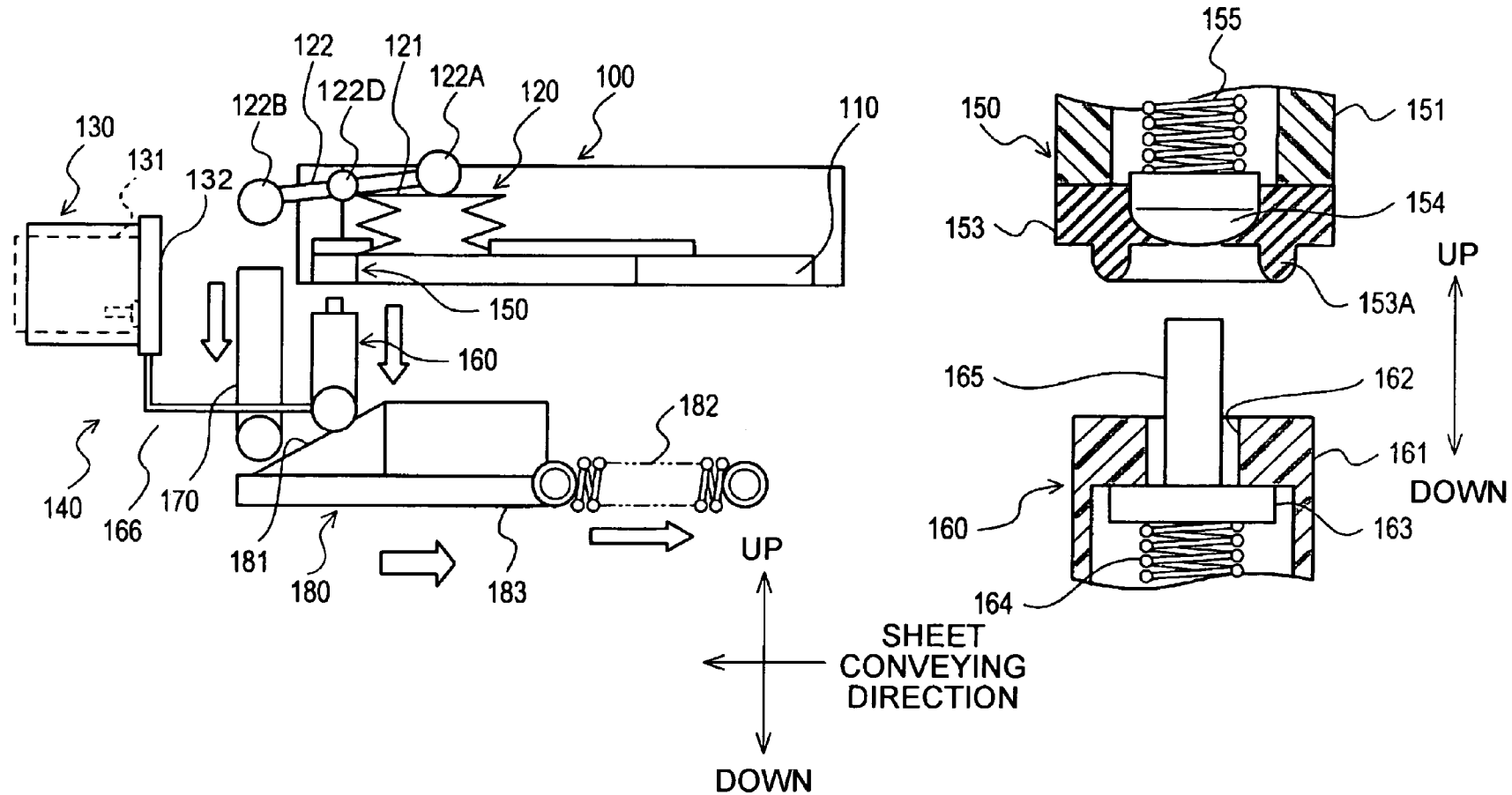
FIG. 3A is an illustrative diagram showing an ink supply operation.
FIG. 3B is an illustrative diagram showing joint valves operated during an ink supply operation.

The sub-tank 121 is configured to deform (expand and contract) elastically in a direction perpendicular to both the main scanning direction and the sheet conveying direction. To be specific, the sub-tank 121 has a form of bellows, as shown in FIG. 3A.

Figure 2A:
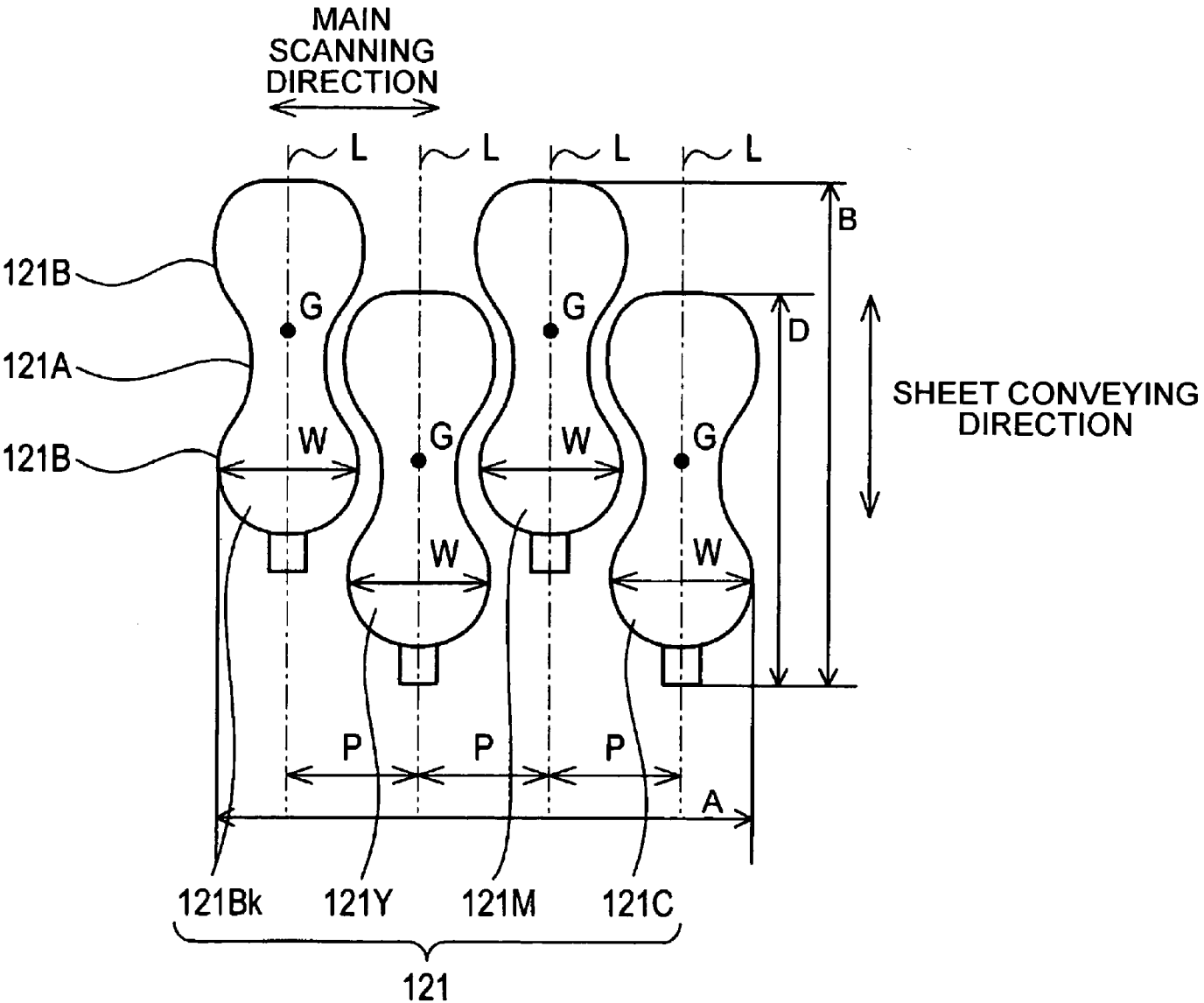
FIGS. 2A and B are top views of sub-tanks according to the first embodiment of the invention.
Figure 2B:
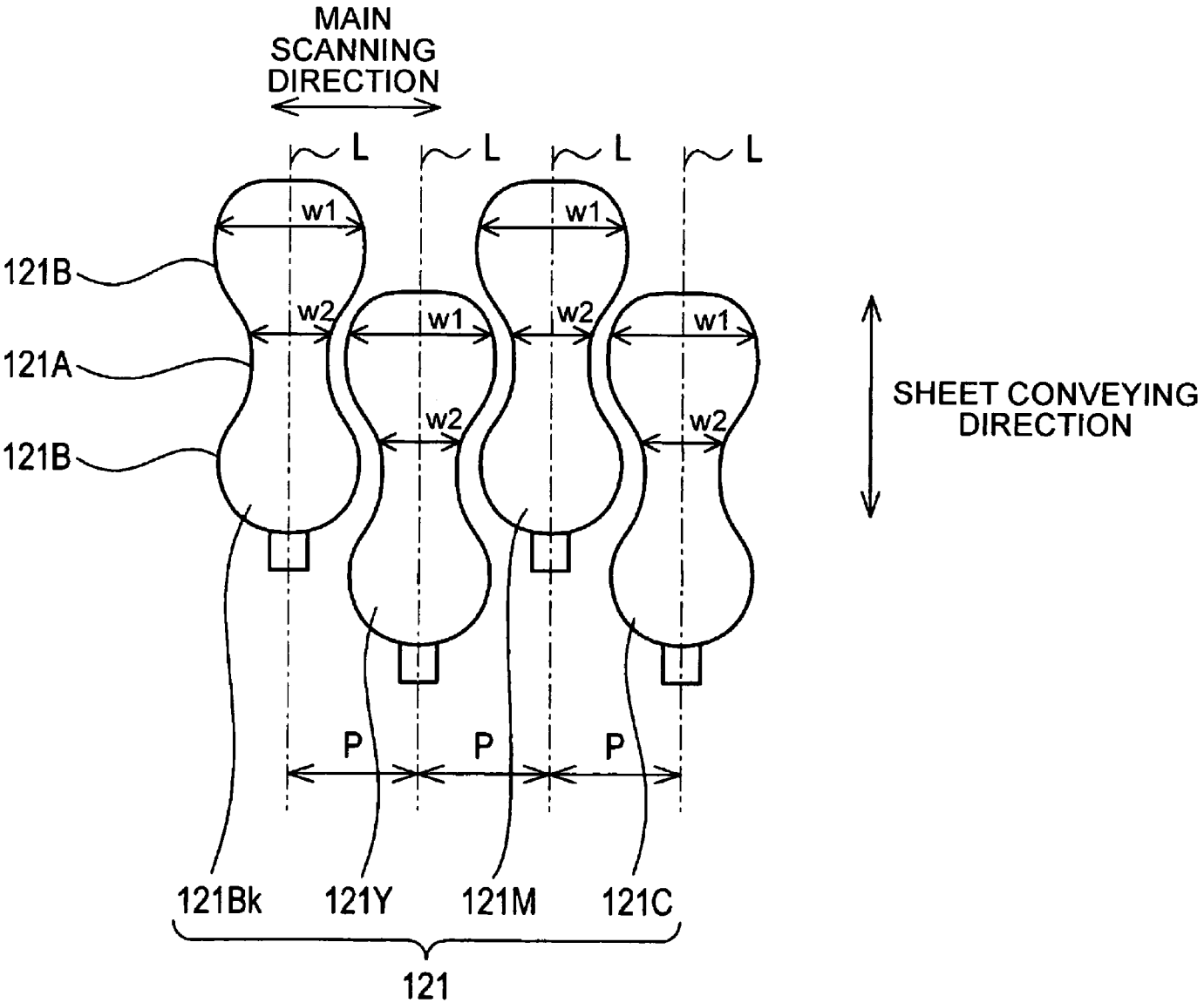

As shown in FIGS. 2A and 2B, the sub-tank 121 is gourd-shaped, and has recesses 121A and protrusions 121B along its outline, as seen in a direction perpendicular to both the main scanning direction and the sheet conveying direction (hereinafter refereed to as a sub-tank deforming direction). The sub-tanks are arranged in a staggered manner in the main scanning direction such that a protrusion 121B of each sub-tank 121 fits in a recess 121A of the adjacent sub-tanks 121.

In this first embodiment, each sub-tank 121 has a cross-sectional shape that is perpendicular to the sub-tank deforming direction. The cross-sectional shape is symmetrical with respect to an imaginary line passing a center G of the shape. The center of a shape means a point where the area moment of a cross-sectional shape balances. The sub-tanks 121 are similar (congruent in this embodiment) to each other. Being similar to each other subsumes being congruent to each other.

The pitch P between adjacent sub-tanks 121 is set to be less than the maximum width (width measured between protrusions) W of each sub-tank 121. Accordingly, in this embodiment, adjacent two of a plurality of sub-tanks 121 overlap each other, at least partially, both as seen in the main scanning direction and as seen in the sheet conveying direction.

As shown in FIG. 2A, the mounting width of the sub-tanks 121 on the printhead unit 100 is less than a value obtained by multiplying the maximum width W of each sub-tanks 121 by the number n of sub-tanks 121 (n=4 in this embodiment), i.e. $A<4W$. The sub-tanks 121 are arranged in two rows in a direction parallel to the main scanning direction. A dimension B of a mounting space for the sub-tanks 121 in a direction parallel to the sheet conveying direction (hereinafter, referred to as a mounting depth of sub-tanks) is less than a value obtained by multiplying the depth (dimension in a direction parallel to the sheet conveying direction) of each of sub-tanks 121 by the number of sub-tank rows arranged in the direction parallel to the main scanning direction, i.e. $B<2D$.

As shown in FIG. 2B, each sub-tank 121 has a width w1 at its one end portion and a width w2 at its middle portion. The width w1 and the width w2 are perpendicular to the mounting depth direction of the sub-tank 121, and the width w1 is larger than the width w2. Two adjacent sub-tanks 121 are arranged such that the width w1 is aligned with the width w2.

As shown in FIG. 3A, the lever 122, as a pushing member, is connected, at its one end 122A, to an upper end of each sub-tank 121 and extends, at its other end 122B beyond an outer edge of the printhead unit 100. The lever 122 is rotatably supported by a support 122D that is fixed to a main body of the printhead unit 100.

As shown in FIG. 3A, the main tank unit 130 includes ink cartridges 131 filled with ink to be supplied to the corresponding sub-tanks 121, and a cartridge casing 132 detachably receiving the ink cartridges 131.

The ink cartridges 131 are mounted in the cartridge casing 132 and are arranged side by side horizontally such that the width direction of the ink cartridges 131 coincides with the horizontal direction. Each of the ink cartridges 131 has a box shape having a relatively small width as compared to its other dimensions.

Construction of a station type ink supply mechanism will now be described. As shown in FIG. 3A, a station type ink supply mechanism (hereinafter referred to as an ink supply mechanism) 140 includes a sub-tank joint valve 150, a main tank joint valve 160, a push rod 170 that pushes the end 122B of the lever 122, and a slide cam 180 that actuates the main tank joint valve 160 and the push rod 170.

The sub-tank joint valve 150, the main tank joint valve 160, and the push rod 170 are provided for each of the sub-tanks 121, and the structures of these members are the same among the sub-tanks 121. The slide cam 180 is provided commonly for the sub-tanks 121, and the slide cam 180 is integral with a base plate 183. Accordingly, all of the sub-tanks 121 are replenished with ink simultaneously. This is the case even if one or more of the sub-tanks 121 do not need to be replenished with ink. The process for replenishing the ink tanks will be described in detail below.

The sub-tank joint valve 150, as a connecting valve, is fixed to the main body of the printhead unit 100 and communicates with the sub-tank 121. As shown in FIG. 3B, a valve cap 153 having a valve opening 152 (FIG. 4B) is sealingly assembled at an end of a cylindrical valve housing 151 near the main tank joint valve 160. The valve opening 152 is closed by a valve member 154 that is shiftable inward of the valve housing 151.

In this first embodiment, the valve cap 153 is made of an elastic material, such as an elastomer, and has an annular projection 153A that surrounds the valve opening 152 and projects toward the main tank joint valve 160.

A coil spring 155, as an elastic member, pushes the valve member 154 from inside the sub-tank joint valve 150 toward the outside of the sub-tank joint valve 150, so as to close the valve opening 152. The initial load and the spring constant of the coil spring 155 are set such that the total (F1+F2) of a pushing force F 1 exerted by a pressure inside the valve housing 151 to close the valve member 154, and a pushing force F2 exerted by the coil spring 155 on the valve member 154, is equal to or slightly greater than a pushing force F3 exerted by the atmospheric pressure to open the valve member 154.

The sub-tank joint valve 150 communicates with the sub-tank 121 at an upper side of the sub-tank 121, and the sub-tank 121 communicates with the printhead 110 at a lower side of the sub-tank 121.

To supply ink from the ink cartridge 131 to the sub-tank 121, the main tank joint valve 160 is connected to the sub-tank joint valve 150, such that the sub-tank 121 communicates with the ink cartridge 131. The main tank joint valve 160 communicates with the ink cartridge 131 via an ink supply conduit such as a pipe or a tube.

As shown in FIG. 3B, a valve opening 162 is provided at an end near the valve cap 153 of a cylindrical valve housing 161. The valve opening 162 is closed by a valve member 163 that is shiftable inward of the valve housing 161.

A coil spring 164, as an elastic member, exerts a pushing force on the valve member 163 to close the valve opening 162. A push rod 165 projects toward the sub-tank joint valve 150 to push the valve member 154 of the sub-tank joint valve 150, so as to open the valve opening 152. The push rod 165 is integral with the valve member 163 and is shifted integrally with the valve member 163.

The slide cam 180 has a cam surface 181 that makes contact with longitudinal lower ends of the push rod 170 and the ink tank joint valve 160 (valve housing 161) to move the push rod 170 and the joint valve 160 in their longitudinal directions (vertically in this embodiment).

In this first embodiment, in order to move the push rod 170 and the main tank joint valve 160 upward, the slide cam 180 is moved leftward in FIG. 3A by a driving force from a discharge roller 190 (see FIG. 1).

In order to move the push rod 170 and the main tank joint valve 160 downward, the driving force from the discharge roller 190 is disconnected and the slide cam 180 is moved rightward in FIG. 3A by an elastic force of a spring 182.

The slide cam 180, which is provided commonly for the sub-tanks 121, is integral with a base plate 183. As shown in FIG. 1, the base plate 183 is provided, on its side near the discharge roller 190, with a rack gear 183A.

A pinion gear 184 that transmits the driving force from a gear 190A, disposed at an longitudinal end of the discharge roller 190, to a rack gear 183A, disposed on the base plate 183, is disposed movably between a position where the pinion gear 184 meshes with the rack gear 183A and a position where the pinion gear 184 is released from the rack gear 183A. The positions of the pinion gear 184 are changed by an actuator. One example of such an actuator is an electromagnetic solenoid.

The discharge roller 190 conveys a sheet, with an image printed thereon, to a discharge port (not shown). The sheet is conveyed between a pair of frames 191 to the discharge port.

Operation of the ink supply mechanism will now be described. The ink supply mechanism 140, as a station type ink supply mechanism, connects the main tank joint valve 160 to the sub-tank joint valve 150, so as to supply ink from the ink cartridge 131 to the sub-tank 121 when the amount of ink remaining in the sub-tank 121 becomes less than a predetermined amount.

In this first embodiment, the time at which the amount of oil remaining in the sub-tank 121 becomes less than the predetermined amount is determined based on the number of ink ejections that are performed by the printhead 10 for both printing and purging. The ink ejections are counted starting from the last time that ink was supplied to the sub-tank 121. When the number of ink ejections reaches a predetermined number, the amount of remaining ink is estimated to be less than the predetermined amount.

When a controller (not shown) that controls operation of the inkjet printer determines that the amount of ink remaining in the sub-tank 121 is less than the predetermined amount, the controller moves the pinion gear 184 to the position to mesh with the rack gear 183A and rotates the discharge roller 190.

Figure 4B:
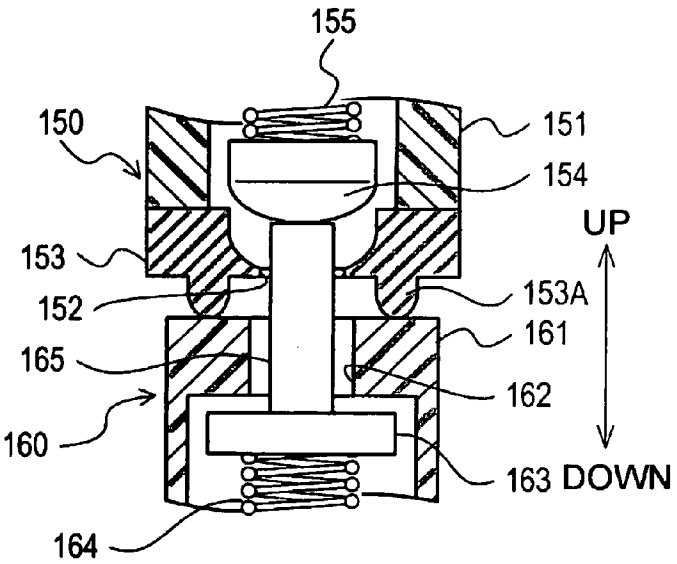
FIG. 4B is an illustrative diagram showing joint valves operated during ink supply operation.
Figure 4A:
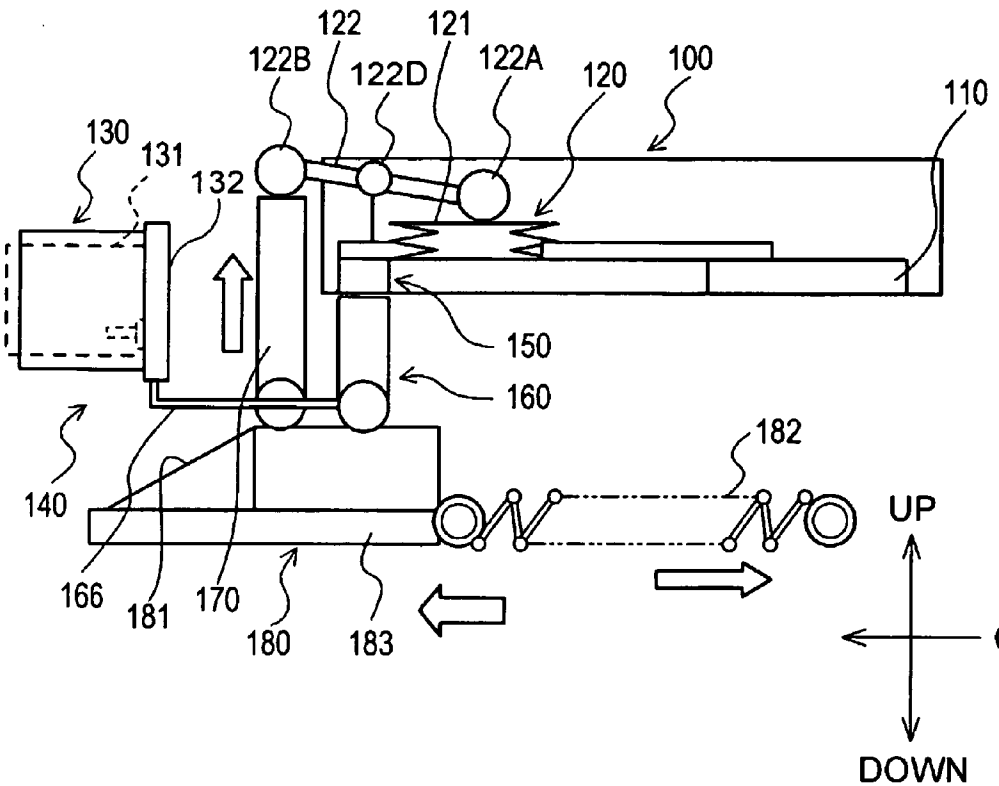
FIG. 4A is an illustrative diagram showing an ink supply operation.

Consequently, the slide cam 180 is moved leftward in FIG. 4A, thereby moving the push rod 170 and the main tank joint valve 160 upward.

As shown in FIG. 4B, the main tank joint valve 160 raises up the valve member 154 of the sub-tank joint valve 150, thereby opening the valve opening 152.

At the same time, the valve member 163 of the main tank joint valve 160 receives a pushing force to open the valve opening 162 via the push rod 165. The valve member 163 is shifted downward to open the valve opening 162, thereby bringing the sub-tank 121 in communication with the ink cartridge 131.

The upper end of the push rod 170 pushes up the other end 122B of the lever 122. As shown in FIG. 4A, the end 122A of the lever 122 moves downward to compress and deform the sub-tank 121. At this time, ink remaining in the sub-tank 121 returns to the ink cartridge 131 and is not wasted.

In this embodiment, the shape of the cam surface 181 and the moving direction of the slide cam 180 are set such that compression of the sub-tank 121 is started after the sub-tank joint valve 150 has been connected to the main tank joint valve 160. If the sub-tank 121 is compressed before the connection between the joint valves 150 and 160, ink might leak from the connecting portions of the joint valves 150 and 160.

Also, the shape of the cam surface 181, and the moving speed of the slide cam 180, are set such that the sub-tank 121 is compressed with a pressure that will not break a meniscus formed in each ejection port of the printhead 110 (e.g. 4 kPa or smaller). If the sub-tank 121 is compressed with an excessively great pressure, the meniscus might be broken.

When a predetermined time has elapsed after the discharge roller 190 is rotated while the pinion gear 184 meshes with the rack gear 183A, or when the total rotation amount of the discharge roller 190 reaches a predetermined amount, the controller determines that the compression of the sub-tank is completed. The controller then moves the pinion gear 184 to the position to be released from the rack gear 183A and stops the discharge roller 190.

Figure 5:
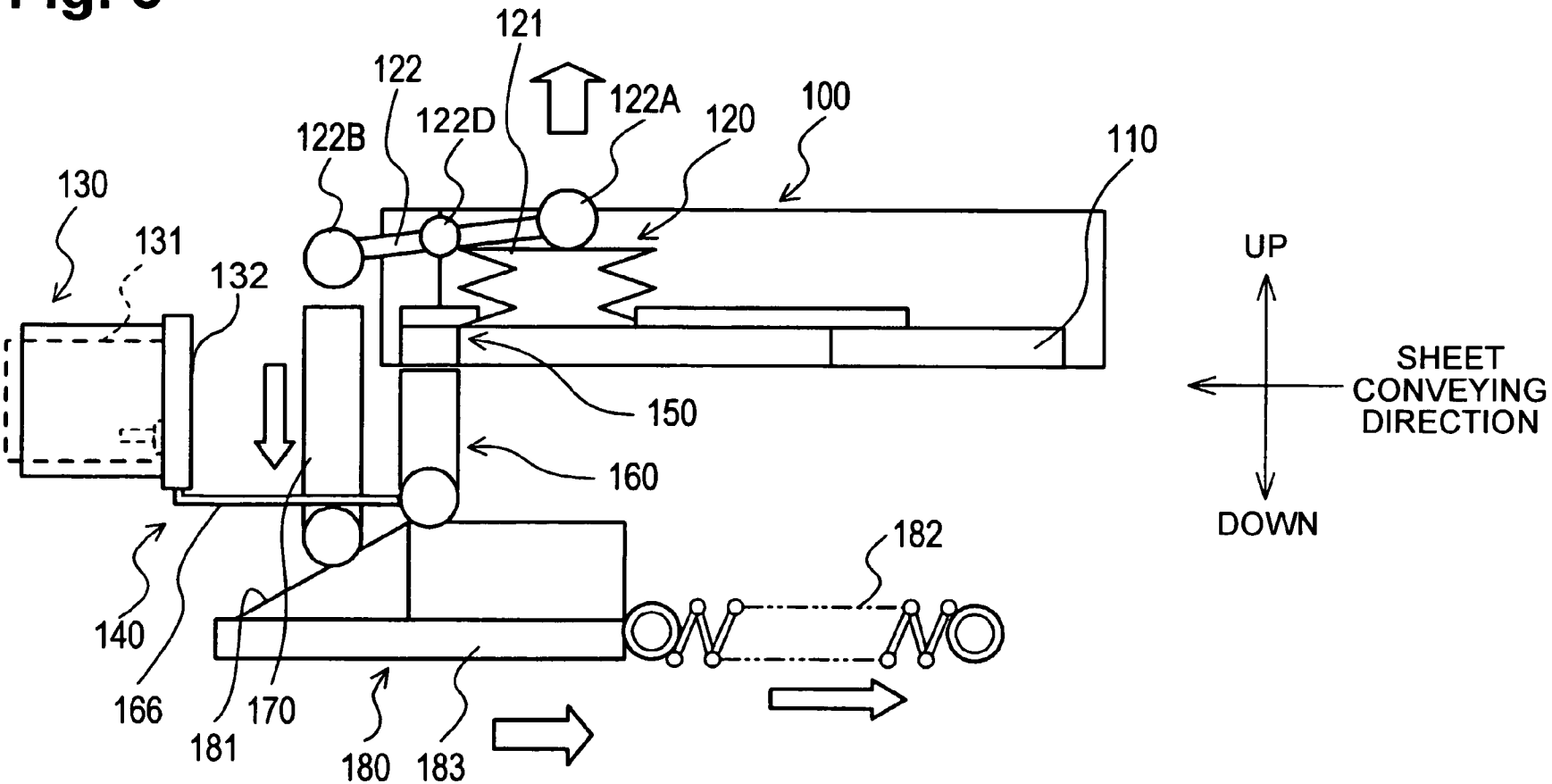
FIG. 5 is an illustrative diagram showing an ink supply operation.

Consequently, as shown in FIG. 5, the slide cam 180 starts moving rightward, the push rod 170 is shifted downward, and the sub-tank 121 expands to return to its original shape. At this time, ink in the ink cartridge 131 is drawn and supplied to the sub-tank 121.

When the slide cam 180 moves further rightward in FIG. 5, the push rod 170 is shifted away from the lever 122, and the joint valves 150 and 160 disconnect from each other and close.

In this embodiment, the shape of the cam surface 181 and the moving direction of the slide cam 180 are set such that the connection between the joint valves 150 and 160 is released after the push rod 170 has been separated from the lever 122. If the connection between the joint valves 150 and 160 are released while the push rod 170 is in contact with the lever 122, ink might leak from the connecting portions of the joint valves 150 and 160.

As shown in FIG. 3, during image forming, the joint valves 150 and 160 are kept disconnected from each other and closed. As ink in the sub-tank 121 is consumed, the sub-tank 121 elastically deforms to contract. The pressure inside the sub-tank 121 lowers and the lowered pressure, which is less than the atmospheric pressure, maintains the meniscus formed in the printhead 110.

At this time, if the pressure inside the sub-tank 121 lowers excessively upon a consumption of a large amount of ink in the sub-tank 121, the pressure difference between the atmospheric pressure and the pressure inside the sub-tank 121 becomes excessively great, causing a breakage of the meniscus.

In this embodiment, however, the initial load and the spring constant of the coil spring 155 are set such that the total (F1+F2) of a pushing force F1 exerted by a pressure inside the valve housing 151 to close the valve member 154, and a pushing force F2 exerted by the coil spring 155 on the valve member 154, is equal to or slightly greater than a pushing force F3 exerted by the atmospheric pressure to open the valve member 154. Accordingly, if the pressure inside the sub-tank 121 lowers excessively, the sub-tank joint valve 150 is opened to increase the pressure inside the sub-tank 121. Then, when the pressure difference between the atmospheric pressure and the pressure inside the sub-tank 121 decreases such that the pressure difference is equivalent to or slightly less than the pushing force of the coil spring 155, the sub-tank joint valve 150 closes. Accordingly, the pressure inside the sub-tank 121 is maintained at a pressure appropriate to maintain the meniscus.

In short, the sub-tank joint valve 150 is automatically controlled to be opened or closed mechanically such that the pressure difference between the atmospheric pressure and the pressure inside the sub-tank 121 is maintained at a pressure difference equivalent to the pushing force of the coil spring 155.

In the inkjet printer according to the first embodiment, adjacent two of the plurality of ink tanks 121 overlap each other at least partially as seen in a direction parallel to the sheet conveying direction. Accordingly, the mounting width of the sub-tanks 121 can be decreased without reducing the size of each sub-tank 121.

In addition, the mounting width A of the sub-tanks 121 is less than a value obtained by multiplying the maximum width W of each sub-tank 121 by the number of sub-tanks 121 (i.e. A<4W). This allows the sub-tank 121 to have a maximum width W which is large enough so that the sub-tank-121 can contract in a stable manner without increasing the mounting width A.

In addition, adjacent two of the plurality of ink tanks 121 overlap each other at least partially as seen in a direction parallel to the main scanning direction. The mounting depth B of the sub-tanks 121 is less than a value obtained by multiplying the depth D of each sub-tank 121 by the number of sub-tank rows arranged in the direction parallel to the main scanning direction (i.e. B<2D). Accordingly, the mounting depth B of the sub-tanks 121 can be prevented from substantially increasing.

Furthermore, each sub-tank 121 has a shape that is symmetrical with respect to an imaginary line that is parallel to the main scanning direction or the sheet conveying direction, as seen in a direction perpendicular to the main scanning direction and the sheet conveying direction. Accordingly, adjacent ink tanks 121 can be arranged in a compact manner.

The sub-tanks 121 are arranged in a staggered manner in the main scanning direction such that the protrusion 121B of each sub-tank 121 fits in the recess 121A of the adjacent sub-tank 121. The depth of the mounting space for the sub-tanks 121 is made smaller than a case (FIG. 8) where the sub-tanks 121 are arranged in a row such that the sub-tanks 121 overlap each other at least partially as seen in the main scanning direction and in the sheet conveying direction.

In addition, the width w1 of one of the adjacent two sub-tanks 121 is aligned with the smaller width w2 of the other of the adjacent two sub-tanks 121. Accordingly, the mounting width of the sub-tanks 121 is prevented from increasing. When the sub-tank 121 contracts, the end portion of the sub-tank 121 in its longitudinal direction is unlikely to protrude while the middle portion is likely to protrude. Thus, the end portion of one of the adjacent two sub-tanks 121, which has the larger width w1, is unlikely to interfere with the middle portion of the other sub-tank 121, which has the smaller width w2. This allows for a reduction in the clearance between the adjacent two sub-tanks 121.

If the sub-tank 121 has a form of bellows, and has a rectangular cross-sectional shape extending in a direction that is perpendicular to the sub-tank deforming direction, then when the sub-tank 121 is pushed to contract it is likely to project at its middle in the expanding/contracting direction or to deform abnormally. This can result in an interference with an adjacent sub-tank 121.

In order to lessen the abnormal deformation of the sub-tank 121, a dimension of the sub-tank 121 parallel to the main scanning direction (hereinafter referred to as the width of the sub-tank 121) could be enlarged to increase the sectional area of the sub-tank 121. However, this approach would enlarge the mounting width of the sub-tanks 121

As another approach to lessen an abnormal deform of the sub-tank 121, a reinforcing guide could be provided to the sub-tank 121. However this approach would increase the number of parts, the number of manufacturing processes, and the manufacturing cost of the inkjet printer.

If the capacity of the sub-tank 121 having the recess 121A and the protrusion 121B along its outline is equal to that of a sub-tank without any recess or protrusion along its outline (e.g. a sub-tank having an oval horizontal cross-section or a rectangular horizontal cross-section), and if the dimension in the expanding/contracting direction of the former sub-tank is equal to that of the latter sub-tank, the maximum width of the former sub-tank is larger than that of the latter sub-tank.

Accordingly, designing the ink tank 121 to have a recess 121A and a protrusion 121*b* along its outline, as described in the first embodiment, can lessen an abnormal deformation of the sub-tank 121 without enlarging the width of the sub-tank 121 or enlarging the mounting width of the sub-tanks 121. Such a design also can lessen an abnormal deformation of the sub-tank 121 without increasing the number of parts, the number of manufacturing processes, or the manufacturing cost.

In the above-described first embodiment, all the sub-tanks 121 are congruent and equal in size. In another embodiment of the sub-tanks 121, as shown in FIG. 6, a sub-tank 121Bk receiving a black ink may be made larger in capacity than other sub-tanks 121Y, 121M, 121C.

Increasing the size of the black ink sub-tank 121Bk increases the number of ink ejections that can be made before the sub-tank 121Bk must be refilled with black ink. This is a benefit since black ink is consumed in a relatively greater amount than the other color inks.

Figure 6:
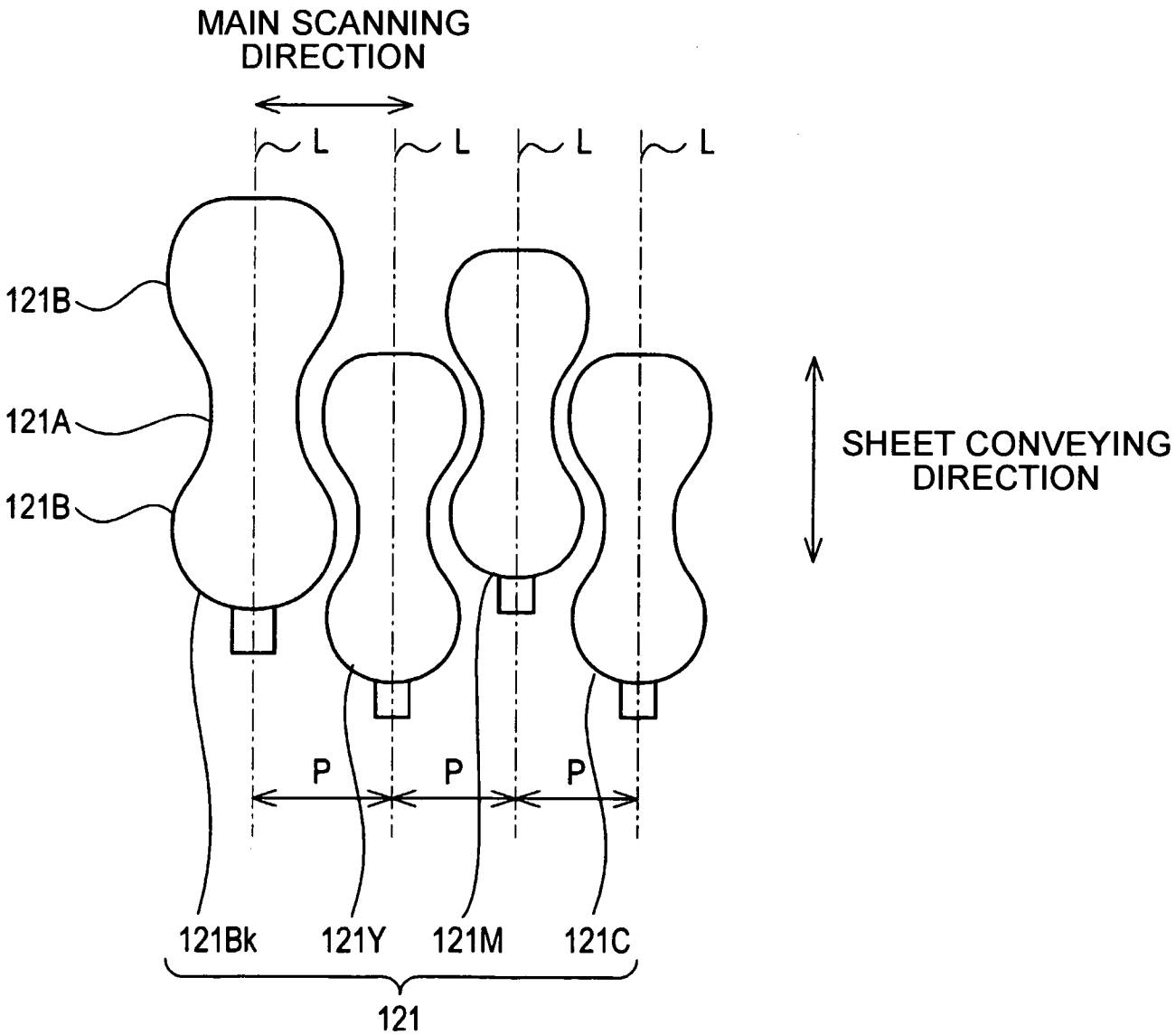
FIG. 6 is a top view of sub-tanks according to another embodiment of the invention.

The capacity of the sub-tank 121Bk is increased by increasing the cross-sectional area of the sub-tank 121Bk, as shown in FIG. 6. Alternatively, the capacity of the sub-tank 121Bk may be increased by increasing the height of the sub-tank 121Bk without increasing the cross-sectional area thereof, or by increasing both the height and the cross-sectional area of the sub-tank 121Bk.

In the above-described first embodiment, the sub-tank 121 has a gourd-shaped horizontal cross-section. As shown in FIGS. 7A, 7B, 7C, and 7D, other embodiments may include sub-tanks 121 with a horizontal cross-section other than the gourd-shape.

Figures 7A, 7B, 7C, 7D:
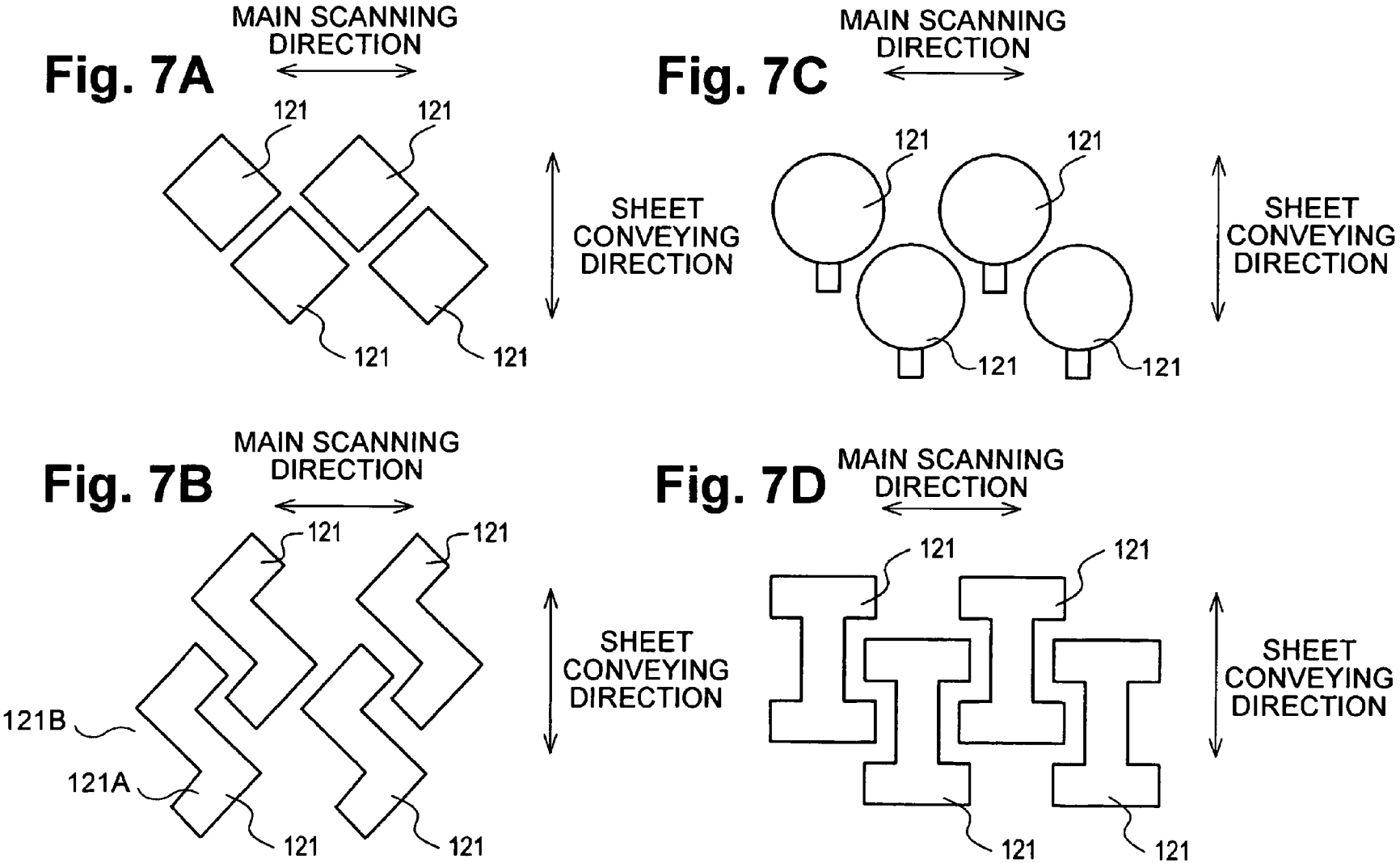
FIGS. 7A, 7B, 7C, and 7D are top views of sub-tanks according to various other embodiments of the invention.

As show in FIG. 7A, a sub-tank 121 has a horizontal cross-section that is rectangular (rhombus or square). As shown in FIG. 7B, a sub-tank 121 has a horizontal cross-section that is S-shaped and has a recess 121A and a protrusion 121B along its outline. As shown in FIG. 7C, a sub-tank 121 has a horizontal cross-section that is circular. As shown in FIG. 7D, a sub-tank 121 has a horizontal cross-section that is I-shaped or H-shaped.

Also, in the embodiments shown in FIGS. 7A-7D, the sub-tanks 121 are arranged in a staggered manner such that two adjacent sub-tanks overlap at least partially as seen in a direction parallel to the main scanning direction and a direction parallel to the sheet conveying direction.

Figure 8:
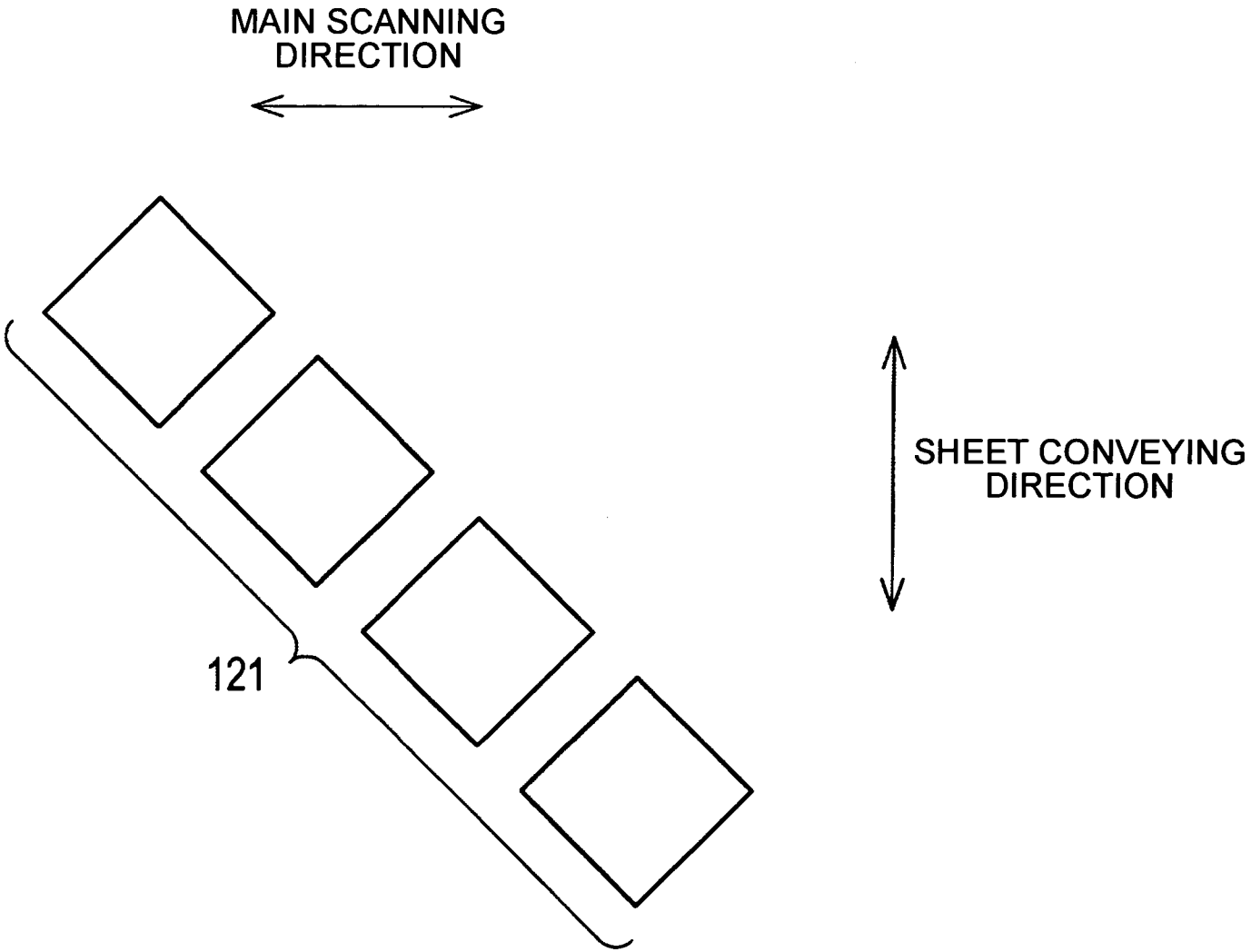
FIG. 8 is a top view of sub-tanks according to yet another embodiment of the invention.

As shown in FIG. 8, in yet another embodiment of the sub-tanks 121, a plurality of sub-tanks may be arranged in a row such that two adjacent sub-tanks overlap at least partially as seen in a direction parallel to the main scanning direction and a direction parallel to the sheet conveying direction. In this modification as well, the mounting width of for the sub-tanks 121 is made small without reducing the size of each sub-tank 121.

Although, in the above-described first embodiment, the sub-tank 121 has a form of bellows, the invention is not limited to this embodiment. For example, the sub-tank 121 may alternatively be a tank configured to be unchanged in volume, or a tank configured to be changed in volume and having a cylinder and a piston.

Although, in the above-described first embodiment, the amount of ink remaining in the sub-tank 121 is estimated based on the number of ink ejections, the invention is not limited to this embodiment. For example, the amount of ink remaining in the tank 121 may be estimated based on changes in the electrical resistance in the sub-tank 121.

Although, in the above-described first embodiment, the sub-tank joint valve 150 communicates with the sub-tank 121 at the upper side of the sub-tank 121 while the sub-tank 121 communicates with the print head 110 at the lower side of the sub-tank 121, the invention is not limited to this embodiment. For example, the sub-tank joint valve 150 may communicate with the sub-tank 1 at the lower side of the sub-tank 121 while the sub-tank 121 may communicate with the print head 110 at the upper side of the sub-tank 121.

Although, in the above-described first embodiment, the main tank joint valve 160 and the push rod 170 are shifted by the slide cam 180, the invention is not limited to this embodiment. For example, the main tank joint valve 160 and the push rod 170 may be shifted by an electrical actuator such as an electromagnetic solenoid.

Although, in the above-described first embodiment, the invention is applied to an inkjet printer adopting a station type ink supply system, the invention is not limitedly applied to this embodiment. For example, the invention may be applied to an inkjet printer in which ink is supplied from the main tank unit 130 to the sub-tank 121 using a flexible tube.

Although, in the above-described first embodiment, the valve member 163 makes direct contact with the periphery of the valve opening 162, an alternative configuration may be provided wherein an O-ring is disposed at contact portions between the valve member 163 and the periphery of the valve opening 162.

The inkjet printer according to the above-described first embodiment may be used, for example, by being connected to a personal computer. In another example, the inkjet printer according to the above-described first embodiment may be adopted as a printing section in a facsimile machine.

The present invention provides an inkjet printer that includes a printhead unit. The print head unit includes a printhead for ejecting ink onto a sheet and a plurality of sub-tanks for supplying the ink to the printhead. The printhead unit is configured to reciprocate in a main scanning direction that is perpendicular to a sheet conveying direction. The plurality of sub-tanks is arranged such that two of the plurality of sub-tanks are adjacent to each other. The adjacent two sub-tanks overlap with each other, at least partially, both as seen in a direction parallel to the main scanning direction and as seen in a direction parallel to the sheet conveying direction.

Because adjacent two of the plurality of ink tanks overlap each other at least partially as seen in a direction parallel to the sheet conveying direction, the mounting width of the sub-tanks can be decreased without reducing the size of each sub-tank.

In addition, because adjacent two of the plurality of ink tanks overlap each other at least partially as seen in a direction parallel to the main scanning direction, the depth of the mounting space for the sub-tanks can also be decreased without reducing the size of each sub-tank.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. An inkjet printer comprising:

a printhead unit including a printhead for ejecting ink onto a sheet and a plurality of sub-tanks for supplying ink to the printhead, and a plurality of ink supply ports connected to the plurality of sub-tanks respectively, the printhead unit being configured to reciprocate in a main scanning direction that is perpendicular to a sheet conveying direction; and a plurality of main tanks, each of which are configured to store ink and supply ink to one of the plurality of sub-tanks via one of the plurality of ink supply ports;

wherein the plurality of sub-tanks is arranged such that two of the plurality of sub-tanks are adjacent to each other; and wherein the adjacent two sub-tanks overlap with each other, at least partially, both as seen in a direction parallel to the main scanning direction and as seen in a direction parallel to the sheet conveying direction.

2. The inkjet printer according to claim 1;

wherein each of the plurality of sub-tanks has a shape that is symmetrical with respect to an imaginary line that is parallel to either the main scanning direction or the sheet conveying direction, as seen in a direction perpendicular to both the main scanning direction and the sheet conveying direction.

3. The inkjet printer according to claim 1;

wherein all of sub-tanks of the plurality of sub-tanks have shapes that are similar to each other, as seen in a direction perpendicular to both the main scanning direction and the sheet conveying direction.

4. The inkjet printer according to claim 1;

wherein the plurality of sub-tanks is arranged in a staggered manner in the main scanning direction.

5. The inkjet printer according to claim 1;

wherein each of the plurality of sub-tanks has a recess and a protrusion along an outline thereof, as seen in a direction perpendicular to both the main scanning direction and the sheet conveying direction.

6. The inkjet printer according to claim 5;

wherein the plurality of sub-tanks is arranged in a staggered manner in the main scanning direction such that the protrusion of one of the adjacent two sub-tanks is fitted into the recess of the other of the adjacent two sub-tanks.

7. The inkjet printer according to claim 1;

wherein each of the plurality of sub-tanks has a first width and a second width, the first width and the second width being perpendicular to a longitudinal direction thereof;

wherein the second width is smaller than the first width; and wherein the first width of one of the adjacent two sub-tanks is aligned with the second width of the other of the adjacent two sub-tanks.

8. The inkjet printer according to claim 1;

wherein a plurality of color inks is supplied to the plurality of sub-tanks respectively, one of the plurality of color inks being black ink; and wherein a sub-tank to which the black ink is supplied is larger in capacity than other sub-tanks to which color inks other than the black ink are supplied.

9. The inkjet printer according to claim 1, further comprising:

a plurality of ink supply units;

wherein each of the plurality of ink supply units is configured to connect one of the plurality of main tanks to one of the plurality of sub-tanks via one of the plurality of ink supply ports.

10. The inkjet printer according to claim 9, further comprising:

a plurality of pushing units;

wherein each of the plurality of pushing units is configured to push one of the sub-tanks in a direction perpendicular to both the main scanning direction and the sheet conveying direction when one of the main tanks is connected to the one of the sub-tanks to be pushed; and wherein the sub-tanks have a form of bellows that are expandable and contractible in the direction perpendicular to both the main scanning direction and the sheet conveying direction.

11. An inkjet printer comprising;

a printhead unit including a printhead for ejecting ink onto a sheet, a plurality of sub-tanks for supplying ink to the printhead, and a plurality of ink supply ports connected to the plurality of sub-tanks respectively, the printhead unit being configured to reciprocate in a main scanning direction that is perpendicular to a sheet conveying direction;

a plurality of main tanks, each of which stores ink;

a plurality of ink supply units, each configured to connect one of the main tanks to one of the sub-tanks via one of the ink supply ports; and a plurality of pushing units, each configured to push one of the sub-tanks in a direction perpendicular to both the main scanning direction and the sheet conveying direction when one of the main tanks is connected to the one of the sub-tanks to be pushed;

wherein the plurality of sub-tanks is arranged such that two of the plurality of sub-tanks are adjacent to each other;

wherein each of the sub-tanks has a form of bellows that are expandable and contractible in the direction perpendicular to both the main scanning direction and the sheet conveying direction; and wherein $A<nW$;

where A is a mounting dimension of the plurality of sub-tanks on the printhead unit in a direction parallel to the main scanning direction, W is the maximum dimension of each of the sub-tanks in the direction parallel to the main scanning direction, and n is the number of the plurality of sub-tanks.

12. The inkjet printer according to claim 11;

wherein $B<mD$;

where B is a mounting dimension of the plurality of sub-tanks on the printhead unit in a direction parallel to the sheet conveying direction, D is a dimension of each of the sub-tanks in the direction parallel to the sheet conveying direction, and m is the number of rows of the sub-tanks arranged in the direction parallel to the main scanning direction.

* * * * *